United States Patent [19]

Wang et al.

[11] Patent Number: 5,024,677

[45] Date of Patent: Jun. 18, 1991

[54] CORROSION INHIBITOR FOR ALCOHOL AND GASOHOL FUELS

[75] Inventors: Sophia L. Wang, Houston; George R. Meyer, Missouri City; Kerry C. Brinkman, Houston, all of Tex.

[73] Assignee: Nalco Chemical Company, Naperville, Ill.

[21] Appl. No.: 536,288

[22] Filed: Jun. 11, 1990

[51] Int. Cl.[5] ..... C10L 5/00

[52] U.S. Cl. ..... 44/335; 44/340; 44/347; 44/451

[58] Field of Search ..... 44/53, 56, 63, 71, 335, 44/340, 347, 451; 252/392, 396

[56] References Cited

U.S. PATENT DOCUMENTS

| | | | |
|---|---|---|---|
| 2,214,152 | 9/1940 | Wilkes | 252/40 |
| 2,267,965 | 12/1941 | Wilson | 564/503 |
| 3,172,892 | 3/1965 | LeSuer | 260/326.5 |
| 3,202,678 | 8/1965 | Stuart et al. | 260/326.5 |
| 3,216,936 | 11/1965 | LeSuer | 252/32.7 |
| 3,219,666 | 11/1965 | Norman | 260/268 |
| 3,254,025 | 5/1966 | LeSuer | 252/32.7 |
| 3,272,746 | 9/1966 | LeSuer | 252/47.5 |
| 4,348,210 | 9/1982 | Sung | 44/53 |
| 4,419,105 | 12/1983 | Sung | 44/53 |
| 4,509,951 | 4/1985 | Knapp | 44/53 |
| 4,511,367 | 4/1985 | Knapp | 252/392 |
| 4,511,368 | 4/1985 | Knapp | 44/53 |
| 4,531,948 | 7/1985 | Knapp | 44/53 |
| 4,863,487 | 9/1989 | Meyer et al. | 44/63 |
| 4,895,578 | 1/1990 | Meyer et al. | 44/63 |

*Primary Examiner*—Margaret B. Medley

*Attorney, Agent, or Firm*—Kinzerm, Plyer, Dorn, McEachran & Jambor

[57] ABSTRACT

Rust of ferrous metal surfaces that are in contact with gasohol or alcohol fuels is inhibited by the addition of a corrosion inhibiting amount of the combination of (A) a substituted imidazoline and (B) an alkenyl succinimide of a mixture of alkylenepolyamines.

21 Claims, No Drawings

CORROSION INHIBITOR FOR ALCOHOL AND GASOHOL FUELS

BACKGROUND OF THE INVENTION

In the past, corrosion of metal surfaces in contact with motor fuels such as gasoline was not much of a problem because such hydrocarbon fuels were non-corrosive and served to limit surface contact with water and moisture. With the advent of fuels partly containing alcohols such as gasohol or straight alcohol fuels, corrosion has become a major problem. Because of their higher water content and acidic impurities, alcohol fuels provide an environment conducive to the oxidation of uncoated ferrous surfaces by dissolved oxygen gas. Acidic contaminants contained in the fuel such as formic and acetic acid can arise during processing or from oxidation of the fuel during storage.

It is known from U.S. Pat. No(s). 4,509,951, 4,511,367, 4,511,368 and 4,531,948 that the combination of a carboxylic acid compound such as dimers and trimers of polyunsaturated fatty acids or alkenyl succinic acid with a nitrogen containing compound such as a polyisobutenyl (PIB) succinimide or a substituted imidazoline is effective as a corrosion inhibitor for alcohol-type motor fuels.

In addition, several proprietary formulations of corrosion inhibitors for alcohol motor fuels are available for sale at the retail level. These include ALCOOL (Shell Oil), GRAND PRIX and PROAL (Bardahl) which are widely used in Brazil.

It has now been found in accordance with the present invention that the combination of an alkenyl succinimide prepared with a mixture of amines and a substituted imidazoline provides improved corrosion inhibiting properties to alcohol-type motor fuel.

The alkenyl succinimide co-additive of this invention, more fully described hereafter, is also a known compound which heretofore has found use, for example, in motor fuel compositions to prevent carburetor deposits and fuel injector clogging as disclosed in U.S. Pat. No(s). 4,863,487 and 4,895,578.

SUMMARY OF THE INVENTION

According to the present invention, metal corrosion caused by alcohol-type motor fuels is inhibited by adding to the fuel a combination of (A) a substituted imidazoline and (B) an alkenyl succinimide of a mixture of alkylenepolyamines.

DESCRIPTION: PREFERRED EMBODIMENTS

The present invention addresses a liquid fuel adapted for use in an internal combustion engine, said fuel comprising from 5 to 100 weight percent of one or more alcohols, from 0 to 95 weight percent gasoline and a corrosion inhibiting amount of fuel additive consisting essentially of the combination of (A) a substituted imidazoline and (B) an alkenyl succinimide of mixture of alkylenepolyamines.

The additive combination may be used at a concentration which provides the required amount of corrosion protection. A useful range is about 1 to 5,000 pounds per thousand barrels (ptb). A preferred concentration range is 1 to 500 ptb. The most preferred concentration range is 1 to 50 ptb.

Component A of the combination is a substituted imidazoline.

The substituted imidazoline (IM) used in the present invention can be represented by the folowing general structure:

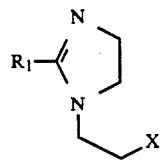

(Formula I)

in which $R_1$ is a hydrocarbon alkenyl group having from about 7 to 24 carbon atoms or a cycloaliphatic hydrocarbon containing from about 6 to 40 carbon atoms. The X in Formula I represents a hydroxyl group (—OH) or an amino group (—$NH_2$).

The imidazolines are readily obtained by reacting suitable organic acids with 2-(2-aminoethylamino) ethanol or diethylenetriamine with the subsequent elimination of two moles of water. This reaction is represented by the following equation where a fatty acid ($R_1=C_{17}$) is reacted with 2-(2aminoethylamino)ethanol:

$$R_1-CO_2H + H_2N-CH_2CH_2-NH-CH_2CH_2-OH \longrightarrow$$

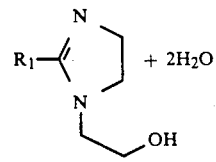

(IM)

In addition to the imidazoline, small amounts of a corresponding amino amide are also obtained. This amino amide is the result of eliminating only one molecule of water between the acid and the amine. Methods of preparing the imidazolines are well known. Useful procedures are described in Wilson U.S. Pat. No. 2,267,965 and Wilkes U.S. Pat. No. 2,214,152.

Acids which are useful in preparing the imidazolines are hydrocarbon monocarboxylic acids having up to about 40 carbon atoms. The preferred acids are unsaturated organic acids such as oleic acid ($C_{18}$) or linoleic acid ($C_{18}$), saturated acids such as stearic ($C_{18}$) acid or cycloaliphatic petroleum acid derived from naphthenic crude oils. In the reaction diagrammed above, to produce the IM, the fatty acid reactant can be, and preferably is, a mixture of oleic acid, linoleic acid and stearic acid Component B of the combination is an alkenyl succinimide of an amine having at least one primary amine group capable of forming an imide group. Representative examples are given in U.S. Pat. No(s). 3,172,892, 3,202,678, 3,219,666, 3,272,746, 3,254,025, 3,216,936 and 4,863,487. The alkenyl succinimides may be formed by conventional methods such as by heating an alkenyl succinic anhydride, acid or lower alkyl ester with an amine containing at least one primary amine group. The alkenyl succinic anhydride may be made readily by heating (at 180°-250° C.) a mixture of olefin and maleic anhydride in a mole ratio of from one to 0.8 to about one to two.

The alkenyl substituent is any olefin having a carbon chain of from 8 to 30 carbon atoms or mixtures thereof, or may be derived from a mixture of olefins most broadly defined as being substantially comprised of olefins having chain lengths of 10 to 30 carbons. Formation of component B follows:

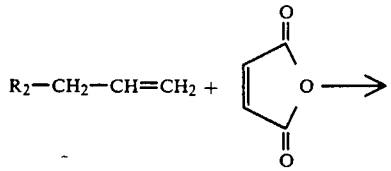

$R_2 = C_7$-$C_{27}$ alpha olefin — maleic anhydride

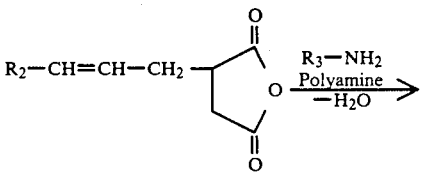

alkenyl succinic anhydride

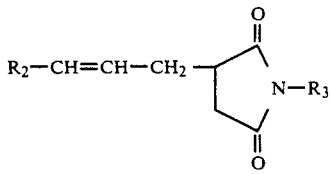

alkenyl succinimide (AS)

The amines ($R_3$—$NH_2$) used to prepare the alkenyl succinimide of the present invention are mixtures of aliphatic and heterocyclic polyamines as set forth in the following table.

| Amine | Percent by Weight |
|---|---|
| Aminoethylethanolamine | 5 to 70 |
| Aminoethylpiperazine | 5 to 30 |
| Triethylenetetramine | 0 to 25 |
| Hydroxyethylpiperazine | 0 to 20 |
| Diethylenetriamine | 0 to 10 |
| Higher oligomers of the above amines | 10 to 85 |

The weight ratio of component A to component B in the combination can vary over a wide range such as 1 to 10 parts A to 10 to 1 parts B. A more preferred ratio is between 2:8 and 5:8 parts by weight of A to B.

Components A and B can be separately added to the alcohol-containing fuel. More preferably components A and B are premixed to form a package, and this package is added to the fuel in an amount sufficient to provide the required degree of corrosion protection.

Tests were conducted to measure the anti-corrosion properties of the additive combination. A laboratory corrosion test method for ethanol fuel was adopted to compare results among various corrosion inhibitor candidates. The test method consists of the following steps:

A. Add 100 ml of the ethanol fuel in a 6 oz. prescription bottle (Sani-Glas RX bottles 1925-02 Brockway Inc.);

B. Dose the sample with the additive;

C. Add a polished steel spindle (G 10180-SAE 1018, the same spindle used in standard NACE test);

D. Place the bottle in a 130° F. hot room;

E. Check and rate the spindles periodically.

The following corrosion inhibitor candidates were tested:

1. The combination of the invention which is (A), a substituted imidazoline (IM) and (B) an alkenyl succinimide (AS) of a mixture of alkylenepolyamines.
2. The substituted imidazoline (IM) alone.
3. the alkenyl succinimide of a mixture of alkylenepolyamines (AS) alone.
4 The three (3) widely used proprietary corrosion inhibitors for alcohol motor fuels—Alcool brand (Shell Oil) and Grand Prix and Proal brands (Bardahl).
5. A combination of a PIB succinic acid (PIBSA) and an alkenyl succinimide of an alkylenepolyamine, as for example that made in compliance with the disclosure of U.S. Pat. No. 4,531,948.
6. The PIB succinic acid (PIBSA) alone.

The test results are summarized and presented in Table I as entries 1-19.

TABLE I

| Additive | ppm | Spindle % Corrosion and NACE Rating 1 day | 4 days | 7 days |
|---|---|---|---|---|
| 1. Blank | — | 30% - C | 40% - C | 55% - D |
| 2. AS + IM | 80 + 50 | 0% - A | <0.1% - $B^{++}$ | 1% - $B^+$ |
| 3. AS + IM | 80 + 20 | — | 1% - $B^+$ | 2% - B+ |
| 4. AS + IM | 80 + 100 | — | 1-2% - $B^+$ | 2% - $B^+$ |
| 5. AS + IM | 800 + 500 | 0% - A | 0% - A | 0% - A |
| 6. IM | 100 | 0% - A | 1-2% - $B^+$ | 2% - $B^+$ |
| 7. IM | 50 | — | 2-3% - $B^+$ | 3% - $B^+$ |
| 8. IM | 20 | — | 9-10% - B | 10% - B |
| 9. IM | 1,000 | 0% - A | 2% - $B^+$ | 2-3% - $B^+$ |
| 10. AS | 100 | 5% - B | 10% - B | 10% - B |
| 11. AS | 1,000 | 1% - $B^+$ | 1% - $B^+$ | 1% - B+ |
| 12. ALCOOL | 100 | 10% - B | 20% - B | 20% - B |
| 13. ALCOOL | 1,000 | 0% - A | 0% - A | 0% - A |
| 14. GRAND PRIX | 100 | 25% - B | — | 55% - D |
| 15. GRAND PRIX | 1,000 | 30% - C | — | 60% - D |
| 16. PROAL | 100 | 5% - $B^+$ | — | 6% - B |
| 17. PROAL | 1,000 | 0% - A | — | 0% - A |
| 18. PIBSA + AS | 100 + 100 | 1% - $B^+$ | 2% - $B^+$ | 3% - $B^+$ |
| 19. PIBSA | 100 | 2% - $B^+$ | 20% - B | 30% - C |

Test results demonstrate the excellent corrosion inhibiting properties of an alcohol fuel containing an additive combination of the invention (entry # 2). Comparison of entries 2, 6, 7, 9, 10 and 11 clearly demonstrates an unexpected synergistic effect in combining the imidazoline (IM) and the alkenyl succinimide (AS) of the invention (entry # 2). Comparison of entry # 2 with entries 12, 14, 15 and 16 shows that the present invention is more effective against corrosion than the most popular proprietary formulations of corrosion inhibitors for alcohol motor fuels. Comparison of entry # 2 (the combination of an imidazoline and a succinimide) with entry # 18 (the combination of a succinic acid and a succinimide per U.S. Pat. No. 4,531,948) indicates that the combination of the present invention is superior.

The corrosion inhibitor of the present invention can be added to fuels which are entirely or partly of the alcohol type, gasohol in general, and specifically ethanol fuels of commercial grade. These fuels are usually characterized by less than six volume percent water, but for the reasons mentioned may be slightly acidic.

Hence, while we have illustrated and described preferred embodiments of the present invention, it is to be understood that these are capable of variation and modification.

We claim:

1. A fuel composition for internal combustion engines comprising (a) a major portion of a fuel selected from gasohol or alcohol, and (b) a corrosion inhibiting amount of a mixture of a substituted imidazoline (IM) having the structure

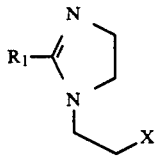

in which $R_1$ is $C_7$–$C_{24}$ alkyl or alkenyl or $C_6$–$C_{40}$ cycloaliphatic and X is —OH or —$NH_2$, and an alkenyl succinimide (AS) having the structure

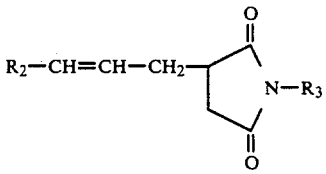

wherein $R_2$ —CH=CH—$CH_2$ is derived from a $C_{10}$–$C_{30}$ alpha olefin and $R_3$-N is derived from a mixture of an aliphatic polyamine, a heterocyclic polyamine, a hydroxyalkylamine and oligomers thereof.

2. A fuel composition for internal combustion engines as claimed in claim 1 wherein said fuel is gasohol.

3. A fuel composition for internal combustion engines as claimed in claim 1 wherein said fuel is ethanol, the fuel containing an impurity selected from the group consisting of water and acetic acid.

4. A fuel composition for internal combustion engines as claimed in claim 3 wherein said fuel is a commercial ethanol.

5. A fuel composition for internal combustion engines as claimed in claim 3 wherein said fuel is a commercial ethanol containing acid.

6. A gasohol composition for internal combustion engines as claimed in claim 2 wherein the mixture of (IM)/(AS) is in the weight ratio of 1 to 10 parts (IM), 10 to 1 parts (AS).

7. A gasohol fuel composition for internal combustion engines as claimed in claim 2 wherein the mixture of (IM)/(AS) is in the weight ratio between 2 to 5 parts (IM) to 8 parts (AS).

8. A gasohol fuel composition for internal combustion engines as claimed in claim 6 wherein $R_1$ is $C_{15}$–$C_{17}$.

9. A gasohol fuel composition for internal combustion engines as claimed in claim 7 wherein $R_1$ is $C_{15}$–$C_{17}$.

10. A gasohol fuel composition for internal composition engines as claimed in claim 9 wherein the amine substituent of the alkenyl succinimide is derived from the group consisting of aminoethylethenolamine, aminoethylpiperazine, triethylenetetramine, hydroxyethylpiperazine and diethylenetriamine.

11. A fuel composition for internal combustion engines as claimed in claim 1 wherein the mixture of (IM)/(AS) is in the weight ratio of 1 to 10 parts (IM), 10 to 1 parts (AS).

12. A fuel composition for internal combustion engines as claimed in claim 1 wherein the mixture of (IM)/(AS) is in the weight ratio between 2 to 5 parts (IM) to 8 parts (AS).

13. A fuel composition for internal combustion engines as claimed in claim 1 wherein $R_1$ is $C_{15}$–$C_{17}$.

14. A fuel composition for internal combustion engines as claimed in claim 12 wherein $R_1$ is $C_{15}$–$C_{17}$.

15. A fuel composition for internal combustion engines as claimed in claim 14 wherein the amine substituent of the alkenyl succinimide is derived from the group consisting of aminoethylethanolamine, aminoethylpiperazine, triethylenetetramine, hydroxyethylpiperazine and diethylenetriamine.

16. A composition comprising a mixture of a substituted imidazoline (IM) having the structure

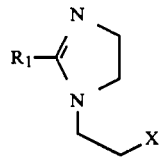

in which $R_1$ is $C_7$–$C_{24}$ alkyl or alkenyl or $C_6$–$C_{40}$ cycloaliphatic, and X is —OH or —$NH_2$, and an alkenyl succinimide (AS) having the structure

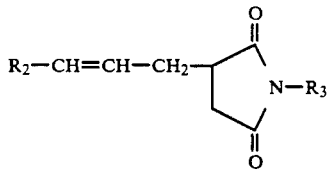

wherein $R_2$—CH=CH=CH—$CH_2$—is derived from a $C_{10}$–$C_{30}$ alpha olefin and $R_3$-N is derived from a mixture of an aliphatic polyamine, a heterocyclic polyamine, a hydroxyalkylamine and oligomers thereof.

17. A composition according to claim 16 wherein the mixture (IM)/(AS) is in the weight ratio of 1 to 10 parts A, 10 to 1 parts B.

18. A composition according to claim 16 wherein the mixture (IM)/(AS) is in the weight ratio between 2 to 5 parts (IM) to 8 parts (AS).

19. A composition according to claim 16 wherein $R_1$ is $C_{17}$ and X is —OH.

20. A composition according to claim 18 wherein $R_1$ is $C_{17}$ and X is —OH.

21. A composition of matter according to claim 20 wherein the amine substituent of (AS) is derived from the group consisting of aminoethylethanolamine, aminoethylpiperazine, triethylenetetramine, hydroxyethylpiperazine and diethylenetriamine.

* * * * *